US009297124B2

(12) United States Patent
Robertson

(10) Patent No.: US 9,297,124 B2
(45) Date of Patent: Mar. 29, 2016

(54) METHODS OF MOVING AT LEAST ONE MAT WITH A CRANE-MOUNTED GRAB HEAD

(71) Applicant: Terrafirma Roadways Limited, Oxford (GB)

(72) Inventor: Hugh Stewart Robertson, Oxford (GB)

(73) Assignee: Newpark Mats & Integrated Services LLC

( * ) Notice: Subject to any disclaimer, the term of this patent is extended or adjusted under 35 U.S.C. 154(b) by 0 days.

(21) Appl. No.: 14/852,589

(22) Filed: Sep. 13, 2015

(65) Prior Publication Data

US 2015/0376846 A1 Dec. 31, 2015

Related U.S. Application Data

(63) Continuation of application No. 14/181,311, filed on Feb. 14, 2014, now Pat. No. 9,132,996.

(30) Foreign Application Priority Data

Feb. 18, 2013 (GB) ..... 1302745.3

(51) Int. Cl.
*B66C 1/66* (2006.01)
*B66C 1/44* (2006.01)
(Continued)

(52) U.S. Cl.
CPC . *E01C 19/52* (2013.01); *B66C 1/44* (2013.01); *B66C 1/447* (2013.01); *B66C 1/66* (2013.01); *B66C 13/46* (2013.01)

(58) Field of Classification Search
CPC ..... B66C 1/28; B66C 1/30; B66C 1/32; B66C 1/427; B66C 1/447; B66C 1/44; B66C 1/66; B66C 13/46; B66F 9/186; E01C 19/52
USPC ..... 294/67.33, 81.21, 81.54, 81.62, 207
See application file for complete search history.

(56) References Cited

U.S. PATENT DOCUMENTS 3,750,814 A * 8/1973 Allegri ..... B66F 9/19 294/81.21
3,905,632 A * 9/1975 Caylor ..... B66C 1/30 294/119.1
4,051,966 A * 10/1977 Cotton ..... B66F 9/183 294/119.1

(Continued)

FOREIGN PATENT DOCUMENTS

CA 2375960 * 3/2002
DE 4107493 * 9/1992

(Continued)

OTHER PUBLICATIONS

Terrafirma Roadways Method Statement for laying Dura Base Mats with truck mounted Epsilon crane, H. Robertson, Terrafirma Roadways; Nov. 14, 2011; 10pp.*

*Primary Examiner* — Dean Kramer
(74) *Attorney, Agent, or Firm* — E Randall Smith; Jones & Smith, LLP

(57) ABSTRACT

Method of handling at least one mat with the use of a crane-mounted grab head includes extending the first tooth of a first jaw of the grab head at least partially through a first hole in the mat and the first tooth of a second jaw of the grab head at least partially through a second hole in the mat. At least one actuator moves the jaws toward one another. The grab head is raised to lift the first mat. The mat is positioned at the desired location and the grab head is disengaged from the mat.

7 Claims, 5 Drawing Sheets

(51) Int. Cl.
*B66C 13/46* (2006.01)
*E01C 19/52* (2006.01)

(56) References Cited

U.S. PATENT DOCUMENTS 4,252,358 A * 2/1981 Klebs ..... B66C 1/62 294/119.1
4,563,031 A * 1/1986 Kishimoto ..... B66C 1/62 294/81.21
4,715,762 A * 12/1987 Lanigan, Sr. ..... B66C 19/007 212/324
4,973,094 A * 11/1990 Tana ..... B66C 1/28 114/44
5,370,435 A * 12/1994 Monk ..... B66F 9/186 294/81.21
5,431,471 A * 7/1995 Baumann ..... B66C 1/663 294/68.3
6,471,274 B1 * 10/2002 Nerger ..... B66C 1/66 294/81.21

FOREIGN PATENT DOCUMENTS

DE 202006004889 * 6/2006
EP 1101869 * 5/2001

* cited by examiner

METHODS OF MOVING AT LEAST ONE MAT WITH A CRANE-MOUNTED GRAB HEAD

CROSS REFERENCE TO RELATED APPLICATIONS

This application is a continuation application of and claims priority to U.S. patent application Ser. No. 14/181,311, filed on Feb. 14, 2014 and entitled "A Crane-Mounted Grab Head", which claims priority to UK Application Number 1302745.3, filed on Feb. 18, 2013, both of which are hereby incorporated by reference herein in their entireties.

FIELD OF THE INVENTION

The present invention is directed towards methods of moving mats with a crane-mounted grab head.

BACKGROUND OF THE INVENTION

In situations where vehicular or pedestrian access is required on certain plots of land, for instance arable land, road or floor mats are often laid to act as a temporary surface to prevent damage to this underlying land.

The floor mats used are generally modular and are usually inserted into position by the use of a crane.

An example floor mat used is the DURA-BASE™ mat by Terrafirma Roadways. A perspective view of this mat is shown in FIG. 1A. The mat is formed of two overlapping rectangular sections. Holes extend around the perimeter of the mat along the non-overlapping portions of the two sections. When two of these mats are placed next to each other, the mats overlap and the holes along the common edge of these two mats line up such that a temporary locking pin can be placed through the holes of both mats to secure the two mats together.

Given their shape and size, handling and placing these mats into position has proved difficult.

One method which has been used has chains which anchor to the four corners of the mat. The chains then connect to a crane arm which lifts the mat. The problem with this lifting method is that the chains are flexible making accurate maneuvering and placing of the mat difficult.

Alternatively, the mat has been placed onto a forklift. When in the correct position, the forklift operator angles the rails of the forklift downward causing the mat to slide off into position. The method is slow and can cause damage to the mats as they are positioned.

An improved method for lifting these mats involves a grab device from Terrafirma which allows mats, such as DURA-BASE™ mats, to be gripped, lifted, and placed into position. The present invention relates to improvements to this grab device.

SUMMARY OF THE INVENTION

According to one aspect of the present embodiment, there is provided a method for using a crane grab head comprising a pair of jaws, a power source for moving the jaws, and a connector for connecting the grab head to a crane, wherein each jaw comprises at least one tooth for engaging with an object;

wherein each jaw is driven by a respective hydraulic/pneumatic cylinder which is slideable linearly to move the jaws between open and closed positions;

wherein the width of the grab head measured between the extremities of the jaws in the closed position is more than 1500 mm; and wherein the separation between a horizontal plane passing through the top of the uppermost cylinder when the head is held freely in normal use and a parallel plane passing through the lowermost edge of the lowermost tooth is less than 250 mm.

The defined separation of this embodiment essentially represents the maximum height of the grab head excluding the connector. By minimizing this separation, the bending moment applied to each tooth when the grab grips a mat is reduced. Reducing the bending moment reduces the chance of each tooth breaking during the gripping process, and thus increases the number of mats which can be positioned by the grab head before a tooth fails. This is of particular importance considering each tooth may be cyclically loaded between a gripping position and a non-gripping position hundreds of times a day.

Also keeping the vertical separation to less than 250 mm allows the grab head of this embodiment to be more conveniently stowed when it is not in use.

The teeth on both jaws of this embodiment may be level with one another. However, preferably the separation on one side is greater than the separation on the other.

This may be achieved, for example, either by offsetting the cylinders for the two jaws, or by having the jaws and/or teeth on one side larger than the other.

The offsetting of the teeth between the two jaws in the grab head means that teeth on one jaw are lower than those on the other. This allows the grab head to pick up objects which are not necessarily flat or which are stepped; for instance a DURA-BASE™ mat, while still maintaining the resultant closing force on the jaws generally in line with the cylinders.

The hydraulic/pneumatic cylinders may be arranged to pull together and push apart the pairs of jaws with equal force either way. This capability of the jaws to grip by either pulling and pushing means that the grab head can be used with much greater flexibility and allows the grab head to separate two mats by pulling them apart in a generally horizontal plane. Existing grab heads are not designed to do this and attempts to do so have resulted in premature breakage of the grab head.

According to a second aspect of the present embodiment, there is provided a method of using a crane grab head comprising a pair of jaws, a power source for moving the jaws, and a connector for connecting the grab head to a crane, wherein each jaw comprises at least one tooth for engaging with an object;

wherein each jaw is driven by a respective hydraulic/pneumatic cylinder which is slideable linearly to move the jaws between open and closed positions;

wherein the width of the grab head measure between the extremities of the jaws in the closed position is more than 1500 mm; and wherein the tooth/teeth of the first jaw are spaced further beneath the cylinders when the head is held freely in normal use than are the tooth/teeth of the other jaw.

As previously described, the offsetting of the teeth between the two jaws in the grab head allows it to pick up objects which are not necessarily flat or which are stepped; for instance a DURA-BASE™ mat, while still maintaining the resultant closing force on the jaws generally in line with the cylinders.

At least one of the pair of jaws may comprise a visual indication which allows the pair of jaws to be distinguished from each other. The visual indication may be the fact that one jaw is colored differently than the other jaw.

According to a third aspect of the present embodiment, there is provided a method of using a crane grab head comprising a pair of jaws, a power source for moving the jaws, and a connector for connecting the grab head to a crane, wherein each jaw comprises at least one tooth for engaging with an object;

wherein each jaw is driven by a respective hydraulic/pneumatic cylinder which is slideable linearly to move the jaws between open and closed positions;

wherein the width of the grab measured between the extremities of the jaws in the closed position is more than 1500 mm; and wherein the pneumatic/hydraulic cylinders are arranged to pull together and push apart the pairs of jaws with equal force either way.

The ability of the grab head to push apart the pairs of jaws allows it to separate two mats in a manner not possible with the prior art described above.

Each jaw may comprise more than one tooth. By increasing the number of teeth present in the grab head, the pressure acting on each tooth by the power source is reduced.

Each tooth preferably comprises a step which extends for less than 15 mm in the direction toward the other jaw, and which is configured to grip a complimentary shoulder of an object.

The cylinders each may have a sold circular cross section. This cross section is preferable to the square cross section currently employed as it reduces the friction losses present in each cylinder. Reducing the friction in each cylinder contributes to the grab head having a low profile since the reduced friction allows the cross sectional width of each cylinder to be reduced.

The grab head may be provided in conjunction with a jaw adaptor which is fastened to one of the jaws, wherein the jaw adaptor comprises at least one auxiliary tooth to take over the role of the tooth/teeth of the jaw to which the adaptor is fastened, such that the adaptor allows the separation between the auxiliary tooth/teeth and the tooth/teeth of the other jaw to be changed as compared to the separation between the tooth/teeth on the jaws without the adaptor in place. The grab head may be provided in conjunction with a floor element wherein the teeth are configured to grip the floor element. The floor element may be in particular a DURA-BASE™ mat.

BRIEF DESCRIPTION OF THE DRAWINGS

An example of an apparatus that may be used in accordance with the methods of the present invention will now be described with reference to the accompanying drawings, in which.

DETAILED DESCRIPTION OF THE PREFERRED EMBODIMENTS

Figure 1A:
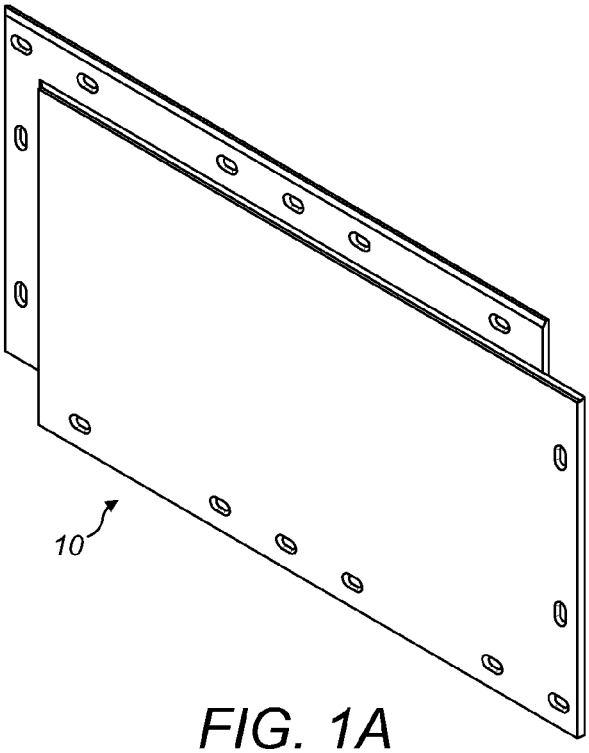
FIG. 1A shows a perspective view of an example DURA-BASE™ floor mat.
Figure 1B:
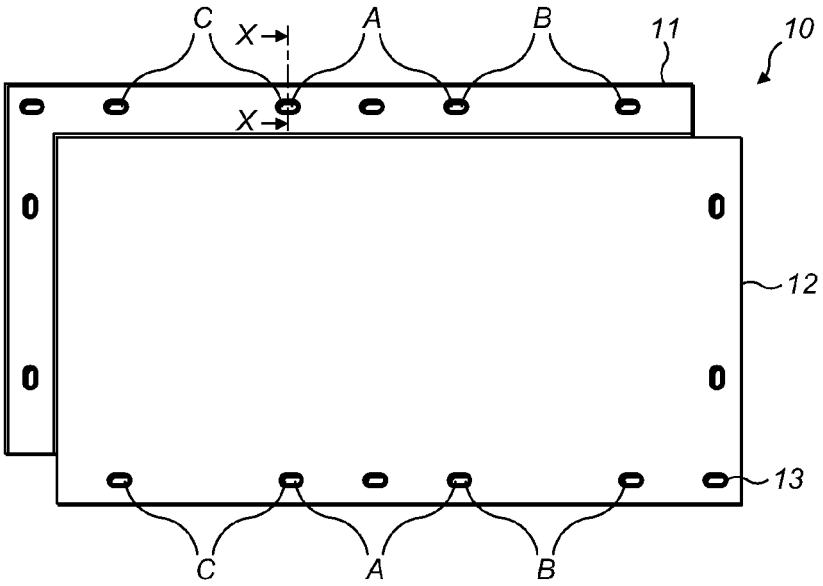
FIG. 1B shows a plan view of the mat.
Figure 1C:
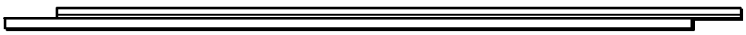
FIG. 1C shows a side view of the mat.

FIGS. 1A-1C show views of an example floor mat 10, or floor element, which the grab head of the present embodiment is designed to grip. The mat 10 is formed of a top and bottom sheet of material 11;12 which overlap each other.

Each exemplary mat 10 or sheet of material 11;12 is formed of any appropriate material that can withstand the load of a vehicle passing over it. Preferably each mat can support a load weight of 40 tones/$m^3$. The mat 10 has a density less than that of water so that it can float on water when loaded less than 250 kg.

Figure 3:
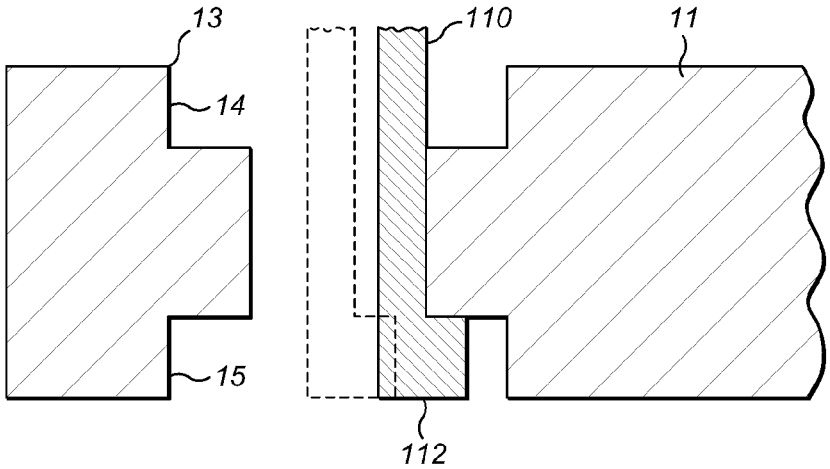
FIG. 3 shows a detailed cross section view of the mat taken across the plane X-X from FIG. 1B when the exemplary crane grab head is grabbing the mat.

The two sheets 11;12 of the mat 10 are slightly displaced horizontally and laterally from one another such that only the top sheet 11 is present along two neighboring sides of the mat 10, and only the bottom sheet 12 is present along the remaining two sides of the mat 10.

Where the two sheets 11;12 do not overlap, a number of holes 13 extend through the projections of sheets 11;12. The cross section of each of these holes 13 is shown in FIG. 3. The distance between the holes may be fixed to a certain spacing so that the holes 13 form hole sets, for example A-A; B-B; and C-C as shown in FIG. 1A. As will be described, these sets are exemplary points where the exemplary grab head picks up the mat 10.

As shown in FIG. 3, a top and bottom ridge 14;15 extends around the top and bottom edges of each hole 13.

Figure 2A:
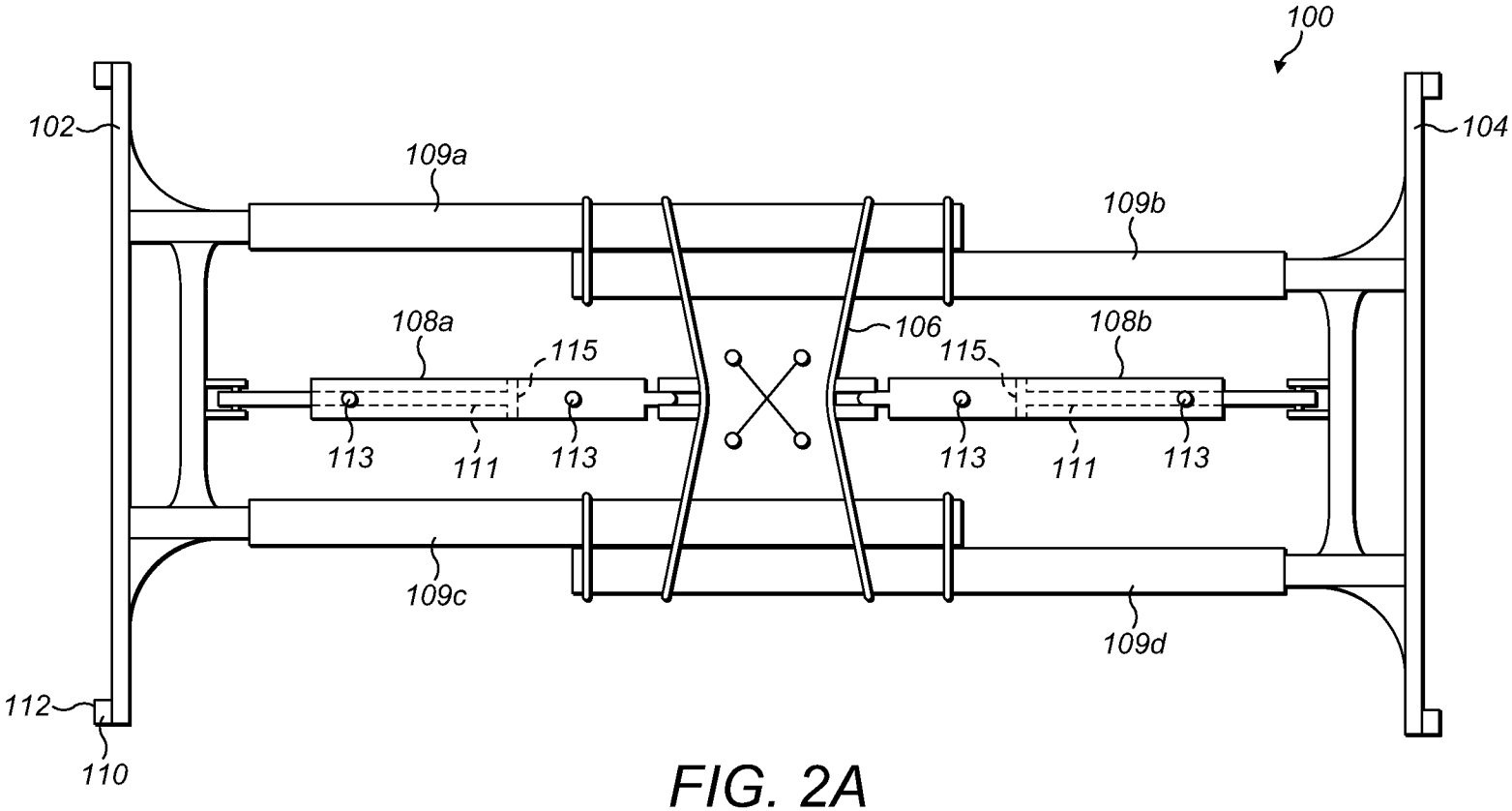
FIG. 2A shows a plan view of an embodiment of a crane grab head according to the present invention.
Figure 2B:
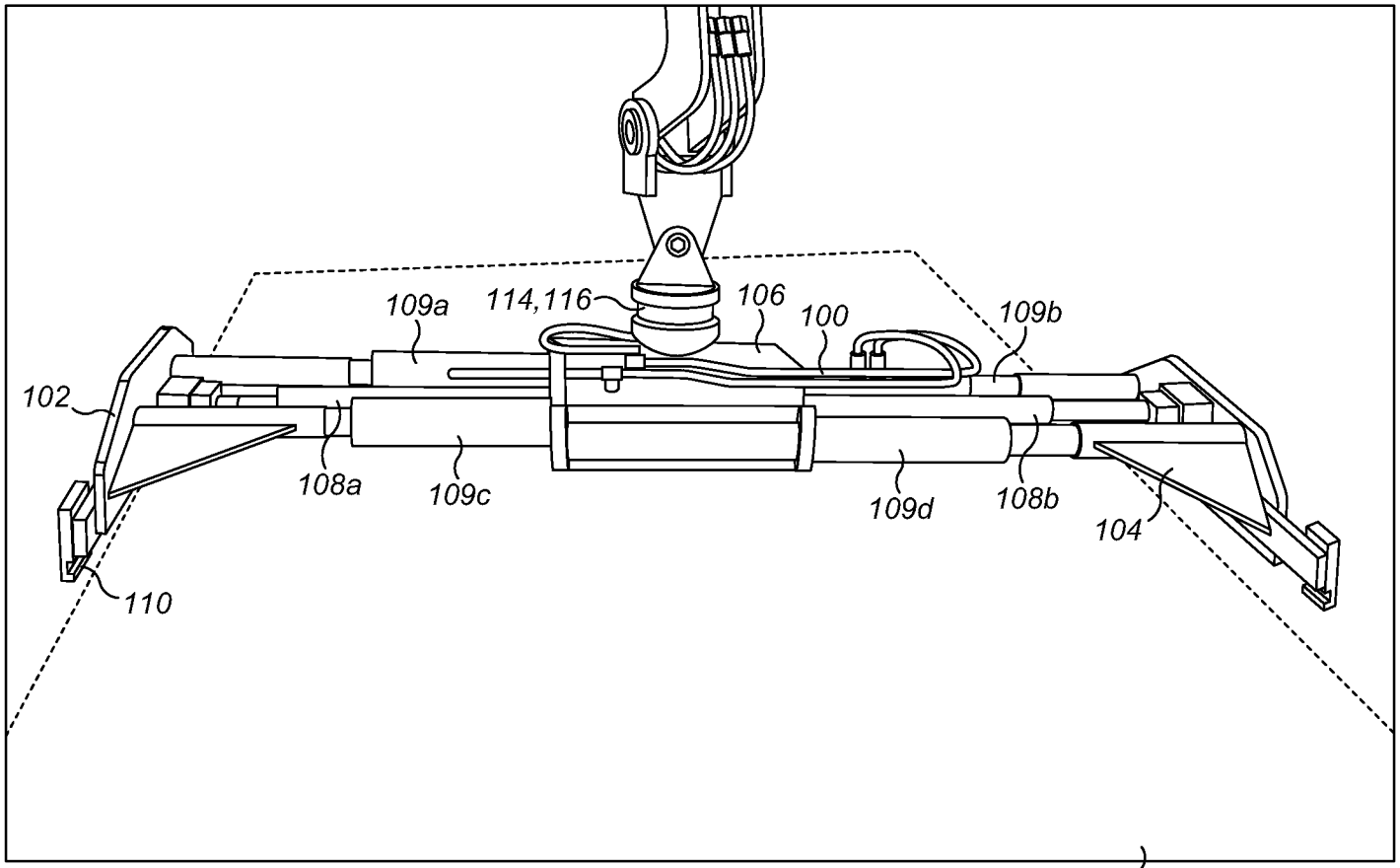
FIGS. 2B and 2C show perspective views of this crane grab head.
Figure 2C:
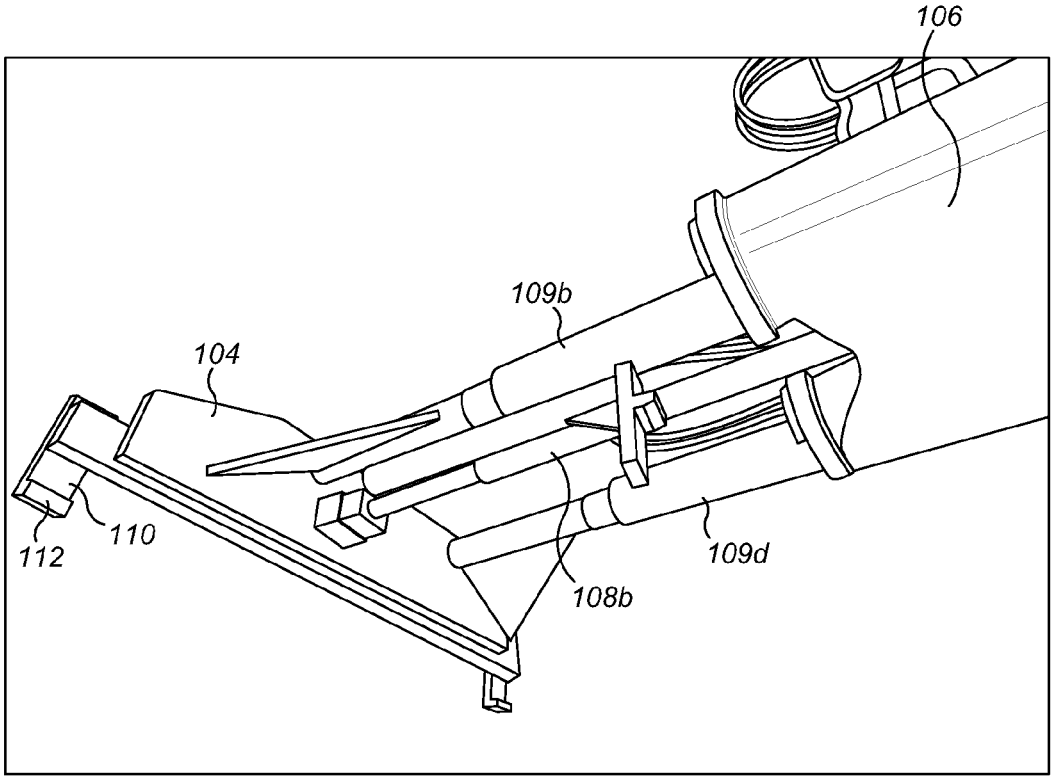

To lift the mat 10, the exemplary crane grab head 100 as shown in FIGS. 2A-C is used. The crane grab head 100 is formed of first and second jaws 102;104 which connect to a central portion 106 via hydraulics or pneumatic actuation cylinders 108*a*;108*b* and telescopic supports 109*a-d*. Each illustrated cylinder and support comprises a rod which slides between an open and closed position. The cylinders 108*a*; 108*b* are coplanar and are orientated parallel with each other. The supports 109*a-d* are also coplanar and are orientated parallel with each other.

In this embodiment, the first and second jaws 102;104 each comprise two teeth 110. Each tooth 110 extends downwardly from the jaw and terminates with a flange 112 which extends in the direction toward the other jaw. The extension of the flange towards the other jaw is preferably less than 15 mm in length, though is more preferably 12 mm.

Although the teeth 110 on each jaw 102;104 are shaped the same and have the same dimensions, the teeth 110 on the first jaw are located closer to the cylinders than are the teeth 110 on the second jaw. The difference in height between the two sets of teeth may be approximately 50 mm. To help the crane operator identify which jaw has the higher set of teeth, and thus identify which is the first jaw, the first jaw comprises a highly visible indication positioned at the top of the jaw. The indication may be in that the first jaw is a different color to that of the second jaw.

Each of the two jaws is connected to the central portion of the crane grab head by one of the two actuation cylinders 108*a*;108*b* and two of the four supports 109*a-d*. Two of the supports 109*a*;109*c* connect the central portion 106 to the first jaw 102, whilst the remaining two supports 109*b*;109*d* connect the central portion 106 to the second jaw 104. To provide maximum support to the exemplary jaws whilst they are being moved, the two supports on each jaw are located on either side of the actuation cylinder for the jaw, which is more centrally located on the jaw.

Each of the two exemplary actuation cylinders 108*a*;108*b* operates in a telescopic fashion such that the distance between each jaw and the central portion can be varied. Each of the cylinders 108*a*;108*b* may also be configured as a double acting ram 111 to allow either a pulling or pushing force to be applied. In this case, each cylinder 108*a*;108*b* comprises a hydraulic/pneumatic port 113 on either side of the ram head 115 to allow it to move both ways.

At the top of the exemplary central portion 106 is a servo-motor or stepper-motor 114 in combination with a pivot joint 116 which allows the grab head to be connected to the remaining part of the crane and also rotated and angled as needed. Electrical connections and pressure lines from the grab head also connect to the remaining part of the crane via the central portion 106.

An equalizer valve may be is used to distribute fluid pressure from a hydraulic/pneumatic pressure source on the crane to each of the cylinders 108*a*;108*b* on the grab head. From the equalizer valve, any conventional hydraulic/pneumatic pressure system can be used to control operation of the double acting ram in each cylinder.

The vertical separation between the bottom of the lowermost tooth/teeth of the exemplary grab head and the top of the cylinders is preferably as small as possible to ensure ease of stowage and minimize the bending moment exerted on each tooth when they are gripping an object. In the embodiment shown in FIGS. 2A-C, the separation between a horizontal plane passing through the top of the uppermost cylinders when the head is held freely in normal use and a parallel plane passing through the lowermost edge of the lowermost tooth is less than 250 mm.

Operation of the exemplary crane grab head is shown best with reference to FIG. 1A and FIG. 3. As previously described, the mat 10 comprises a series of hole sets A-A; B-B; and C-C. The separation between the holes in each sheet from these sets is the same. The separation and size of each hole in each set is also such to allow the two teeth from each jaw of the crane grab head to pass through all the holes in the set.

Taking the example of the four holes indicated by hole set A-A, in use the crane operator initially orientates the exemplary crane grab head, via the stepper-motor 114 and the pivot joint 116, and spaces the jaws, via the cylinders 108*a*;108*b*, such that the teeth from the first jaw are positioned over the two holes from the hole set which are located on the top sheet 11 and the teeth from the second jaw are positioned over the remaining two holes from the hole set located on the bottom sheet 12.

The crane operator then lowers the exemplary crane grab head such that the teeth enter the holes A-A of the mat into the dotted position as shown in FIG. 3. In this embodiment, in situations where the mat 10 is placed flat on the ground, the operator will know when the teeth are in the dotted position shown in FIG. 3 since he will feel resistance in the movement controls of the crane due to the bottom of the teeth in the second jaw making contact with the ground.

Figure 4:
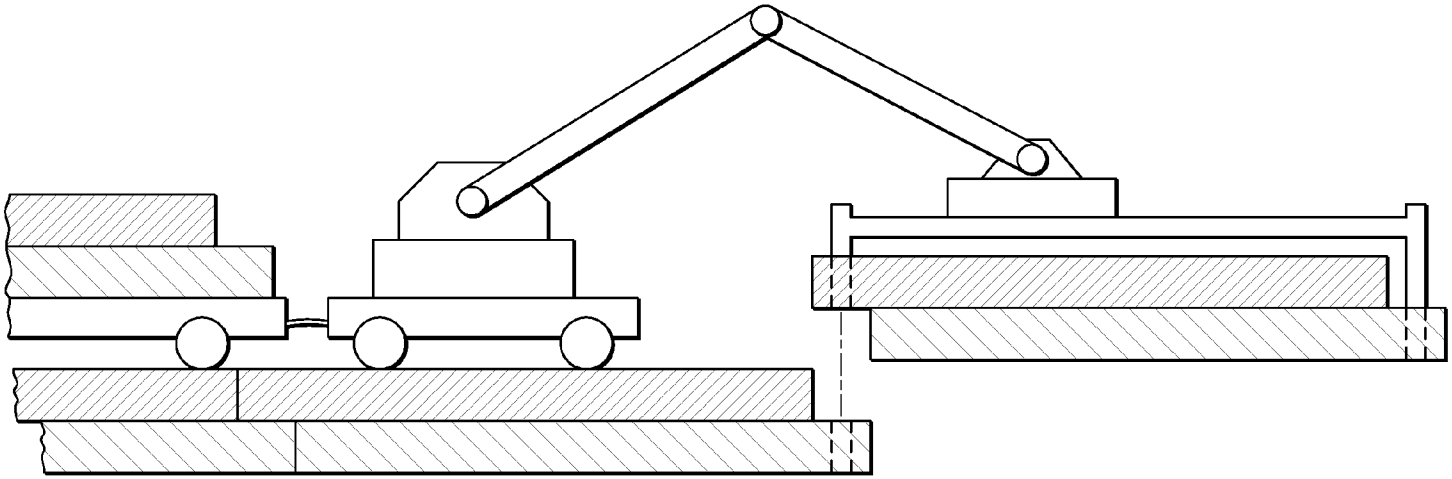
FIGS. 4 and 5 each show a side view of a crane placing a gripped mat into position next to an already positioned mat with the exemplary crane grab head.

From this dotted position, the operator then moves the exemplary jaws together via the cylinders 108*a*;108*b* such that the flange of each tooth overlaps the bottom ridge 15 of each hole 13 to grip and lift the mat as shown in FIG. 4.

From the dotted position, the operator alternatively may move the exemplary jaws apart, rather than bring them together, such that the outer face of each tooth makes contact with the outer edge of each hole 13. Moving the jaws outward provides an alternative way of gripping the mat.

In this embodiment, the crane operator then releases the teeth from engagement with the edges of the holes, using the cylinders, and returns the jaws to the dotted position shown in FIG. 3. From here, the crane operator then raises the crane grab head away from the newly positioned mat.

The two mats can then be secured together by a locking pin or any other fastening means.

The above process can then be repeated with a new mat as required.

In some instances, it may be that the crane operator wishes to place a mat alongside an already positioned mat which has a top sheet, rather than a bottom sheet, sticking out. In this case, the crane operator must slide the bottom sheet of the new mat underneath the top sheet of the already positioned mat to allow the two mats to be connected.

Figure 5:
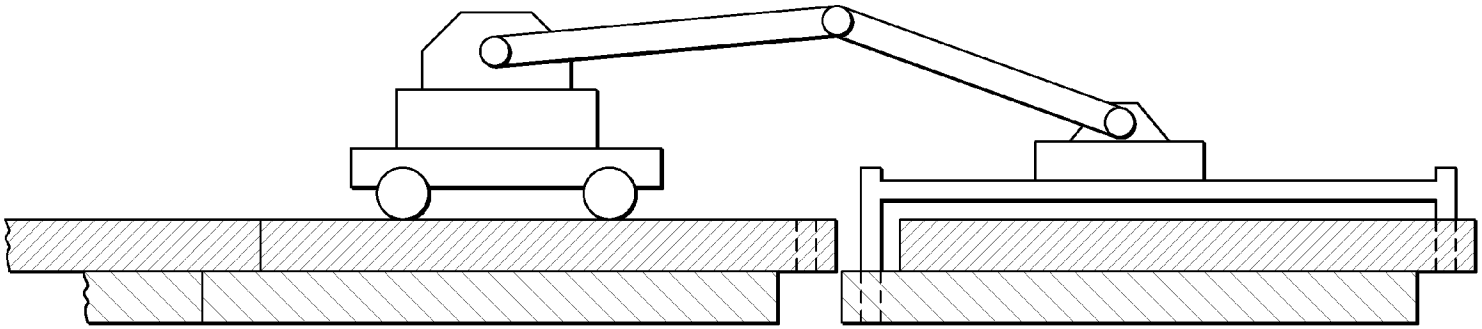

To slide the new mat underneath the already positioned mat, the operator first places the new mat next to the already placed mat as shown in FIG. 5. The operator then disconnects the second jaw from the mat, tilts the crane grab head from the new mat, and then expands the second jaw, which previously engaged with the pair of holes in the lower sheet of the new mat, such that it engages with the pair of holes in the upper sheet of the already placed mat. In this position, as the first and second jaws are each connected to a pair of holes in an upper sheet of a mat, the grab head may be slightly angled from the horizontal to compensate for the fact that the teeth of the second jaw are positioned slightly lower than the teeth from the first jaw.

Once both the jaws are engaged with their holes in the upper sheets of the mats, the operator pulls the jaws together using the cylinders 108*a*;108*b*. Since the weight of the crane is acting on the already placed mat, when the jaws are pulled together the new mat is the mat which moves. Thus the bottom sheet of the new mat slides underneath the top sheet from the already positioned mat and into a position for fastening.

In this embodiment, to separate the new mat from the already positioned mat after use, the previously described process may be reversed as follows:

i) the crane is positioned on the already placed mat as shown in FIG. 5. The grab head is then slightly angled from the horizontal such that the teeth from the second jaw are positioned in the holes of the upper sheet in the already placed mat and the teeth from the first jaw positioned in the holes of the upper sheet in the new mat;

ii) once both the jaws are engaged with their respective holes as in i), the operator then pushes the jaws apart using the cylinders 108*a*;108*b* such that the outer face of the teeth in the first jaw make contact with the outer edge of each hole 13. Since the weight of the crane is acting on the already placed mat, when the jaws are pushed apart the new mat slides laterally out from under the already placed mat (which remains stationary) into the position shown in FIG. 5;

iii) once the new mat is in the position shown in FIG. 5, the new mat is then lifted as previously described (by re-engaging the flange of each tooth with the bottom ridge 15 of each hole 13).

The ability to push two mats apart may be useful in situations other than the one described above, such as if two mats are stuck together.

Thus it will be appreciated that the outer side of each tooth can be used to separate two mats apart and the inner side of each tooth can be used to bring two mats together. However, only the inner side of each tooth, which comprises the flange which engages with the ridge in the mat, is used to lift the mat.

Whenever a mat is gripped, it is preferable to use hole set A-A, rather than B-B or C-C. As the holes in A-A are the most centrally located on the mat, gripping the mat with these holes reduces the bending forces exerted on the teeth when the mat is lifted.

In some embodiments of the grab head, one or both of the jaws may include a detachable adaptor. The adaptor includes a further tooth which is similar in shape to any of the other teeth previously described. The purpose of this auxiliary tooth is to take over the role of the teeth of the jaw to which the adaptor is fastened, such that the adaptor allows the separation between the auxiliary tooth and the teeth of the other jaw to be changed as compared to the separation between the teeth on the jaws without the adaptor in place.

The invention claimed is:

1. Method of handling at least one mat with the use of a crane-mounted grab head, each mat being configured to withstand the load of a vehicle passing over it, each mat having at least first and second spaced-apart holes extending therethrough and at least first and second peripheral sides opposite one another, each mat further having a stepped-configuration that includes a first projection extending at least partially along at least the first side of each mat and a second projection extending at least partially along at least the second side of each mat, the first and second projections being offset heightwise relative to one another so that the first projection is lower than the second projection when each mat is upright, wherein at least the first hole is formed in the first projection and at least the second hole is formed in the second projection, the grab head including a central portion engageable with the crane, at least first and second elongated telescoping supports extending linearly from and in opposite lateral directions relative to the central portion, each of the first and second supports having a central longitudinal axis, a first jaw disposed proximate to the end of the first support opposite the central portion and a second jaw disposed proximate to the end of the second support opposite the central portion, and at least one actuator configured to selectively and independently move each of the first and second jaws toward and away from one another, each jaw including at least a first tooth extending downwardly therefrom, each tooth of each jaw having at least one flange projecting in the direction of the other jaw, the first tooth of the first jaw being engageable with the first hole in each mat and, concurrently, the first tooth of the second jaw being engageable with the second hole in each mat, wherein when the central longitudinal axis of the first and second supports is oriented generally horizontally, the flange of each tooth of the first jaw is configured to be positioned farther downwardly relative to the central portion of the grab head than the flange of each tooth of the second jaw, the method comprising:

(a) the crane extending the first tooth of the first jaw of the grab head at least partially through the first hole in a first mat and the first tooth of the second jaw of the grab head at least partially through the second hole in the first mat;

(b) at least one actuator of the grab head moving the first and second jaws toward one another sufficient to position each flange of each respective tooth at least partially below the first mat adjacent to the corresponding associated hole of the first mat;

(c) the crane raising the grab head to lift the first mat;

(d) the crane placing the first mat at a desired location;

(e) at least one actuator of the grab head moving the first and second jaws away from one another to align each flange of each respective tooth in or below the corresponding associated hole of the first mat; and (f) the crane lifting the grab head away from the first mat.

2. The method of claim 1 further including (g) the crane placing the first mat at a desired location on the ground.

3. The method of claim 2 further including (h) repeating steps (a)-(f) with respect to a second mat, (i) the crane placing the second mat at a desired location on the ground proximate to the first mat, and (j) interconnecting the first and second mats to form a temporary surface.

4. The method of claim 3 further including (k) repeating steps (a)-(f) with respect to multiple subsequent mats, (l) the crane placing each subsequent mat at a desired location on the ground proximate to at least one other mat, and (j) interconnecting the mats to form a temporary surface.

5. The method of claim 1 wherein when the first mat and a second mat are positioned adjacent to one another on the ground, further including the crane engaging the first tooth of the first jaw with a hole formed in the first mat and the first tooth of the second jaw with a hole formed in the second mat, and at least one actuator of the grab head moving the first and second jaws away from one another with sufficient force to push at least one among the first and second mats away from the other.

6. Method of displacing at least one among first and second mats positioned adjacent to one another on the ground from the other such mat with the use of a crane-mounted grab head, each mat being configured to withstand the load of a vehicle passing over it, each mat having at least first and second spaced-apart holes extending therethrough, the grab head including a central portion engageable with the crane, at least first and second elongated telescoping supports extending linearly from and in opposite lateral directions relative to the central portion, a first jaw disposed proximate to the end of the first support opposite the central portion and a second jaw disposed proximate to the end of the second support opposite the central portion, each jaw including at least first and second spaced-apart teeth extending downwardly therefrom, each tooth of each jaw having at least one flange projecting in the direction of the other jaw, and at least one actuator configured to selectively and independently move each of the first and second jaws toward and away from one another with equal force, the method comprising:

the crane extending each tooth of the first jaw of the grab head at least partially through the first and second holes in the first mat;

the crane extending each tooth of the second jaw of the grab head at least partially through the first and second holes in the second mat;

at least one actuator moving the first and second jaws away from one another with sufficient force to push at least one among the first and second mats away from the other; and the crane lifting the grab head away from the first and second mats.

7. The method of claim 6 further including at least one actuator moving the first and second jaws toward one another to position each flange of each respective tooth in or below the corresponding associated hole in the first or second mat.

* * * * *